US010611601B2

(12) United States Patent
Guillot

(10) Patent No.: US 10,611,601 B2
(45) Date of Patent: Apr. 7, 2020

(54) SECONDARY CAR OPERATING PANEL FOR ELEVATOR CARS

(71) Applicant: Otis Elevator Company, Farmington, CT (US)

(72) Inventor: Nicolas Guillot, Coullons (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 398 days.

(21) Appl. No.: 15/690,335

(22) Filed: Aug. 30, 2017

(65) Prior Publication Data

US 2018/0086595 A1 Mar. 29, 2018

(30) Foreign Application Priority Data

Sep. 23, 2016 (EP) ..... 16290182

(51) Int. Cl.

| | |
|---|---|
| ***B66B 1/52*** | (2006.01) |
| ***B66B 1/46*** | (2006.01) |
| ***B66B 3/00*** | (2006.01) |
| ***B66B 5/00*** | (2006.01) |

(52) U.S. Cl.

CPC ..... *B66B 1/52* (2013.01); *B66B 1/467* (2013.01); *B66B 3/00* (2013.01); *B66B 5/0012* (2013.01)

(58) Field of Classification Search

CPC ..... B66B 3/008; B66B 3/002; B66B 1/3415; B66B 5/0012; B66B 2201/4607; B66B 1/52

See application file for complete search history.

(56) References Cited

U.S. PATENT DOCUMENTS

| | | | | |
|---|---|---|---|---|
| 6,031,519 | A * | 2/2000 | O'Brien | G03H 1/0005 345/156 |
| 6,161,654 | A * | 12/2000 | Sirigu | B66B 3/00 187/391 |
| 6,161,655 | A * | 12/2000 | Lejon | B66B 1/461 187/388 |
| 8,253,548 | B2 | 8/2012 | Oh et al. | |
| 8,310,746 | B2 | 11/2012 | Kim et al. | |
| 9,045,314 | B2 | 6/2015 | Finschi | |
| 9,230,368 | B2 | 1/2016 | Keane et al. | |
| 2005/0236906 | A1 | 10/2005 | Morgan et al. | |
| 2006/0011419 | A1 | 1/2006 | Chuang | |

(Continued)

FOREIGN PATENT DOCUMENTS

| | | |
|---|---|---|
| CN | 204400366 | 6/2015 |
| CN | 204802795 | 11/2015 |

(Continued)

OTHER PUBLICATIONS

European Search Report, European Application No. 16290182.1, dated Mar. 28, 2017, European Patent Office; Search Report 8 pages.

*Primary Examiner* — Marlon T Fletcher
(74) *Attorney, Agent, or Firm* — Cantor Colburn LLP

(57) ABSTRACT

Elevator car systems including a primary car operating panel fixedly located on an elevator car panel and a secondary car operating panel display system. The Display system includes a detection and tracking device configured to detect the entry and location of passengers within the elevator car and a display device configured to display a secondary car operating panel at a location proximate to a detected and tracked passenger.

13 Claims, 7 Drawing Sheets

(56) References Cited

U.S. PATENT DOCUMENTS

| | | | | |
|---|---|---|---|---|
| 2009/0236185 | A1* | 9/2009 | Yumura | B66B 13/26 187/317 |
| 2011/0253486 | A1* | 10/2011 | Lee | B66B 5/027 187/392 |
| 2015/0096843 | A1* | 4/2015 | Siddiqui | B66B 1/2416 187/380 |
| 2015/0232300 | A1* | 8/2015 | Preston | B66B 1/468 187/395 |
| 2016/0130500 | A1 | 5/2016 | Chen et al. | |

FOREIGN PATENT DOCUMENTS

| | | | |
|---|---|---|---|
| JP | 2010143683 | | 7/2010 |
| JP | 2012185634 | | 9/2012 |
| WO | 2005113399 | A1 | 12/2005 |
| WO | 2015183256 | A1 | 12/2015 |

* cited by examiner

SECONDARY CAR OPERATING PANEL FOR ELEVATOR CARS

CROSS-REFERENCE TO RELATED APPLICATIONS

This application claims the benefit of European Application No. 16290182.1, filed Sep. 23, 2016, which is incorporated herein by reference in its entirety.

BACKGROUND

The subject matter disclosed herein generally relates to car operating panels of elevator systems and, more particularly, to easy-access secondary car operating panels for elevator systems.

Elevator systems, and particularly elevator cars, include car operating panels that are accessible by passengers to indicate a desired destination. In order for a passenger to indicate a desired floor, the passenger must access the car operating panel and interact with various buttons, inputs, or other device or functions. However, when the elevator car is crowded, access to the car operating panel may be difficult or hampered, and thus a passenger may not be able to input a desired destination after entering the elevator car. Accordingly, it may be advantageous to provide easier access for passengers to input desired destination information into an elevator system.

SUMMARY

According to one embodiment, an elevator car is provided having a primary car operating panel fixedly located on an elevator car panel and a secondary car operating panel display system. The secondary car operating panel display system includes a detection and tracking device configured to detect the entry and location of passengers within the elevator car and a display device configured to display a secondary car operating panel at a location proximate to a detected and tracked passenger.

In addition to one or more of the features described above, or as an alternative, further embodiments of the elevator car may include that the secondary car operating panel display system further includes a secondary car operating panel controller operably connected to the detection and tracking device and the display device, the secondary car operating panel controller configured to receive input from the detection and tracking device, control the display device to display the secondary car operating panel at a specific location, and receive input from the display device in response to the display device detecting a passenger input.

In addition to one or more of the features described above, or as an alternative, further embodiments of the elevator car may include that the secondary car operating panel controller is configured to not display a secondary car operating panel if at least one of (i) the detected and tracked passenger is located within a predetermined distance from the primary car operating panel, (ii) an input is received at the primary car operating panel within a predetermined time from a time of detection of the passenger, or (iii) a display time expires without receiving an input at the secondary car operating panel.

In addition to one or more of the features described above, or as an alternative, further embodiments of the elevator car may include that the display device and the detection and tracking device are housed as a single unit.

In addition to one or more of the features described above, or as an alternative, further embodiments of the elevator car may include that the display device is at least one of an image projector, a touch screen, or a holographic projector.

In addition to one or more of the features described above, or as an alternative, further embodiments of the elevator car may include that the detection and tracking device includes at least one of an optical sensor, an infrared sensor, a camera, a proximity sensor, a floor sensor, a pressure sensor, an acoustic sensor, or a motion sensor.

According to another embodiment, a method for operating an elevator car having a primary car operating panel is provided. The method includes detecting entry of a passenger into the elevator car with a detection and tracking device, tracking the position of the passenger within the elevator car with the detection and tracking device, and displaying a secondary car operating panel proximate to the detected and tracked passenger.

In addition to one or more of the features described above, or as an alternative, further embodiments of the method may include, prior to displaying the secondary car operating panel, at least one of (i) determining the position of the passenger relative to the primary car operating panel, (ii) determining a timing of an input at the primary car operating panel, or (iii) starting a display timer.

In addition to one or more of the features described above, or as an alternative, further embodiments of the method may include that at least one of (i) the secondary car operating panel is not displayed when the position of the passenger is within a predetermined distance from the primary car operating panel or (ii) the display of secondary car operating panel is stopped at the expiration of the display timer.

In addition to one or more of the features described above, or as an alternative, further embodiments of the method may include that when the input at the primary car operating panel occurs within a predetermined time of detecting entry of the passenger the secondary car operating panel is not displayed.

In addition to one or more of the features described above, or as an alternative, further embodiments of the method may include that the secondary car operating panel is displayed using at least one of an image projector, a touch screen, or a holographic projector.

In addition to one or more of the features described above, or as an alternative, further embodiments of the method may include that the detection and tracking includes use of at least one of an optical sensor, an infrared sensor, a camera, a proximity sensor, a floor sensor, a pressure sensor, an acoustic sensor, or a motion sensor.

In addition to one or more of the features described above, or as an alternative, further embodiments of the method may include detecting a passenger input at the secondary car operating panel.

In addition to one or more of the features described above, or as an alternative, further embodiments of the method may include controlling the elevator car in response to the passenger input.

In addition to one or more of the features described above, or as an alternative, further embodiments of the method may include indicating on the primary car operating panel information related to the passenger input.

Technical effects of embodiments of the present disclosure include a secondary (or virtual) car operating panel that is displayed proximate to a newly entering passenger into an elevator car. Further technical effects include detection of entry of passengers into an elevator car, tracking of the newly entering passenger, and displaying a secondary car operating panel in proximity to the new passenger. Further technical effects include a decision process to display or not display a secondary car operating panel in proximity to a newly entering passenger based on a distance from a primary car operating panel or based on a timing of an input at the primary car operating panel.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
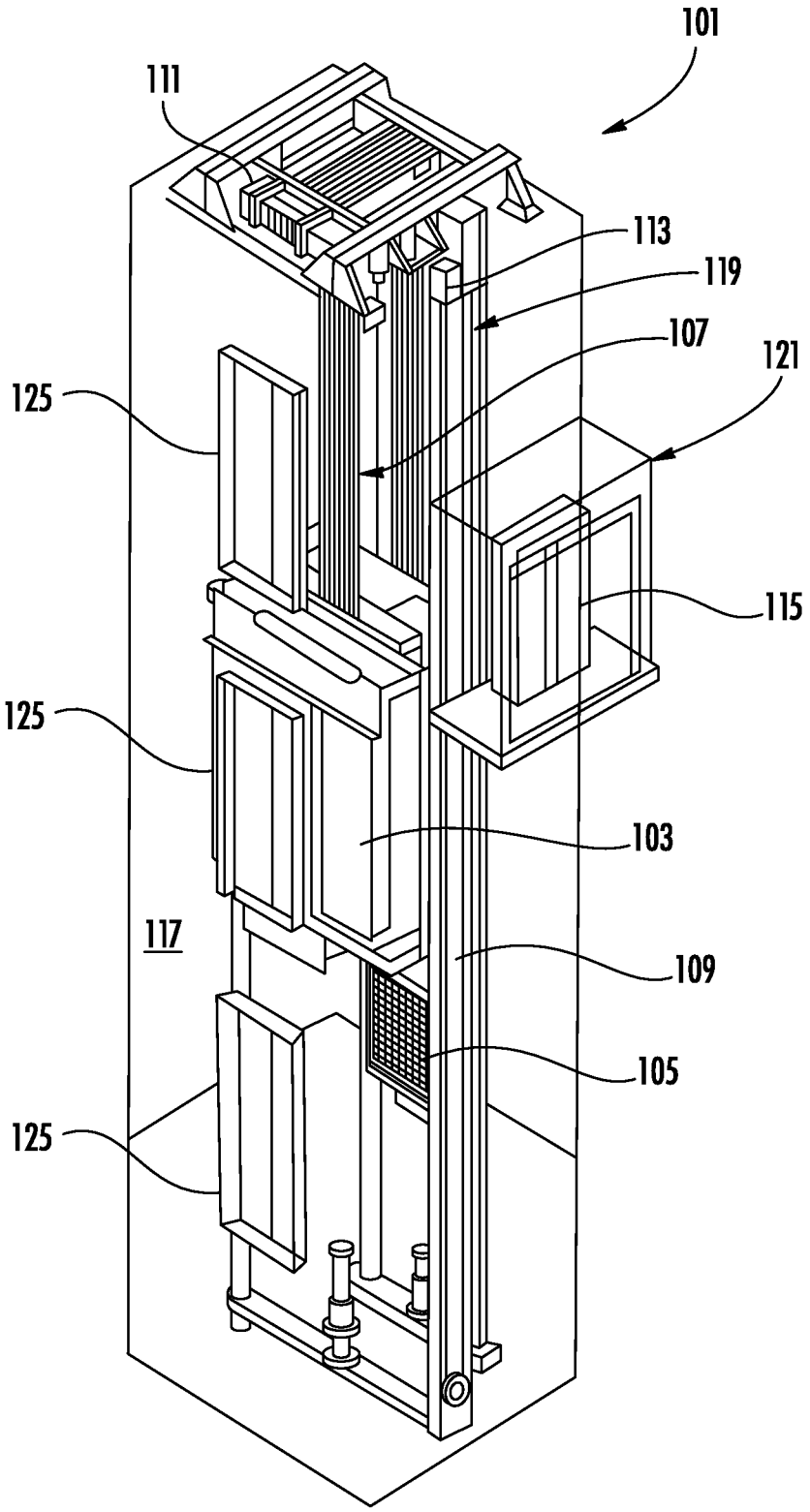
FIG. 1 is a schematic illustration of an elevator system that may employ various embodiments of the present disclosure.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "##" that is shown in FIG. X may be labeled "X ##" and a similar feature in FIG. Z may be labeled "Z ##." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

Figure 2A:
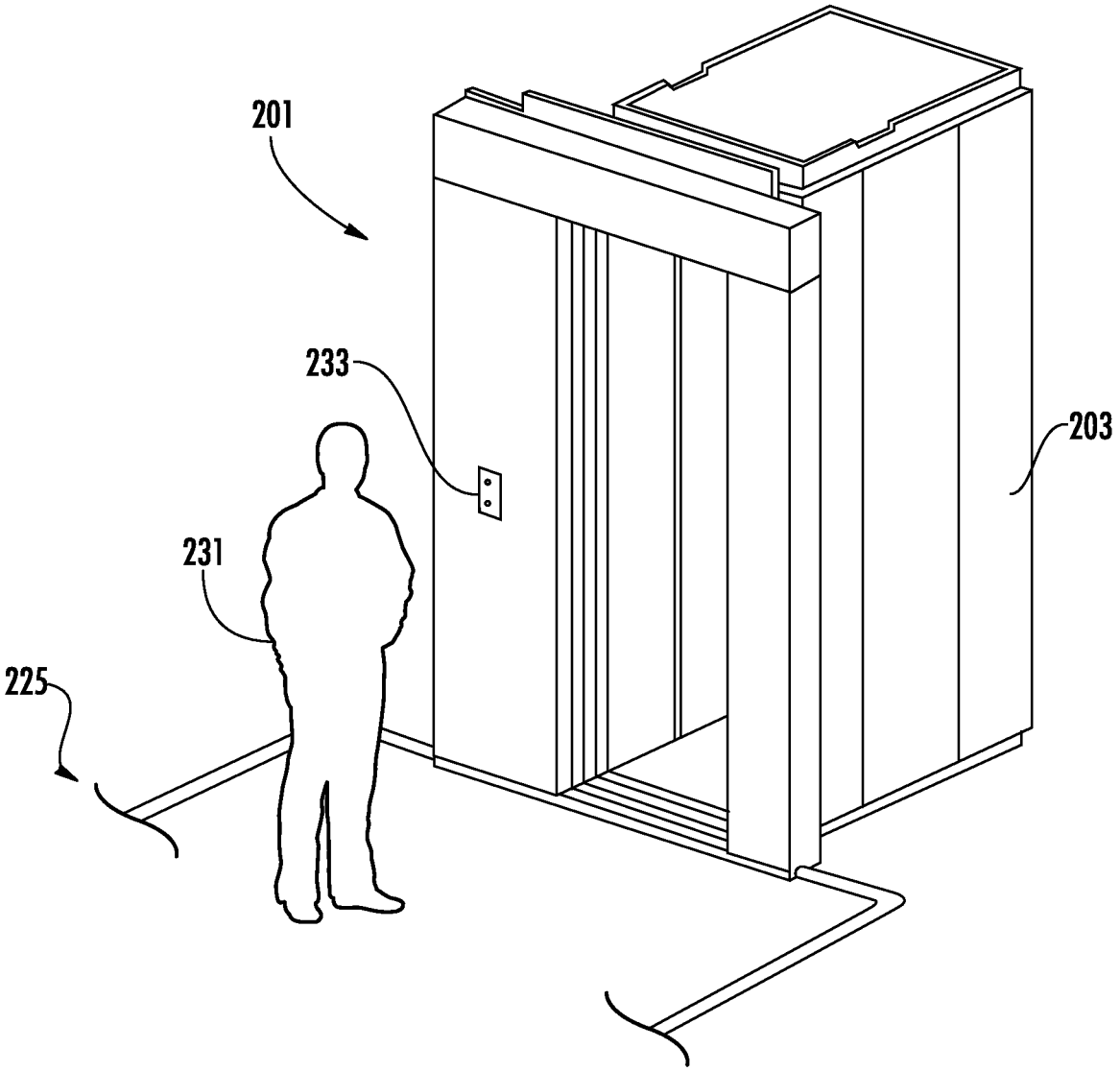
FIG. 2A is a schematic illustration of an elevator car that may incorporate features of the present disclosure.
Figure 2C:
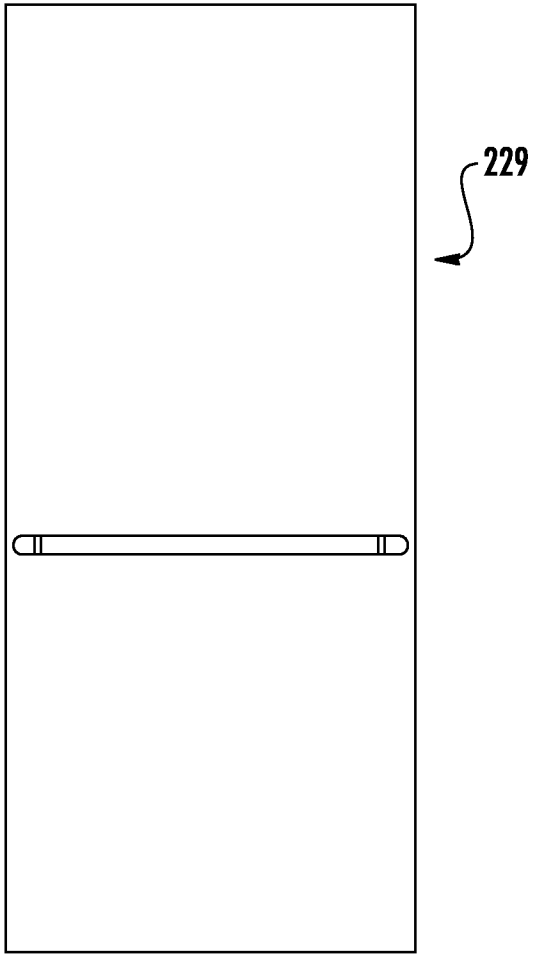
FIG. 2C is an elevation schematic illustration of another elevator car panel of the elevator car of FIG. 2A.
Figure 2B:
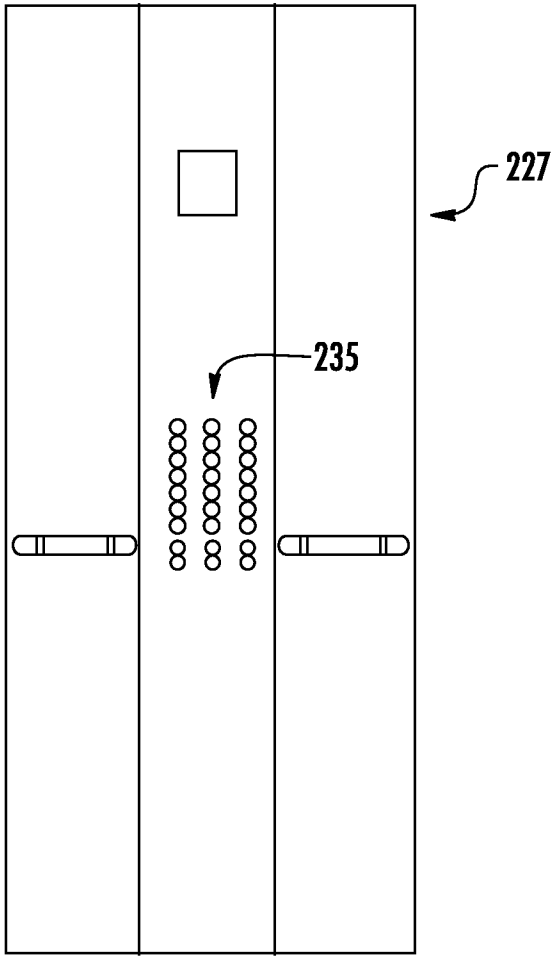
FIG. 2B is an elevation schematic illustration of an elevator car panel of the elevator car of FIG. 2A.

Turning to FIGS. 2A-2C, schematic illustrations of an elevator car 203 and elevator car panels 227, 229 that can employ embodiments described herein are shown. FIG. 2A is a schematic illustration of the elevator car 203 as viewed from a landing 225. FIG. 2B shows a front elevation schematic view of a first elevator car panel 227 of the elevator car 203. FIG. 2C shows a front elevation schematic view of a second elevator car panel 229 of the elevator car 203. A passenger 231 may call the elevator car using a hall call panel 233. Upon arrival of the elevator car 203 at the landing 225, the passenger 231 may enter the elevator car 203 and attempt to access or reach a car operating panel 235 to select a desired destination floor. Elevator cars typically include one or maybe two car operating panels 235 depending on the configuration of the elevator car 203. For example, in some configurations, the first elevator car panel 227 may represent a portion of the elevator car 203 that is next to an elevator door, and thus one car operating panel 235 may be located on either side of the elevator door. However, as shown, the second elevator car panel 229, which may represent all elevator car panels that do not include the elevator car door, does not include a car operating panel. As such, when the passenger 231 enters the elevator car 203, the passenger 231 may have to interfere with other passengers in order to reach the car operating panel 235. This is particularly true in a full or busy elevator car with a high number of occupants.

Figure 3:
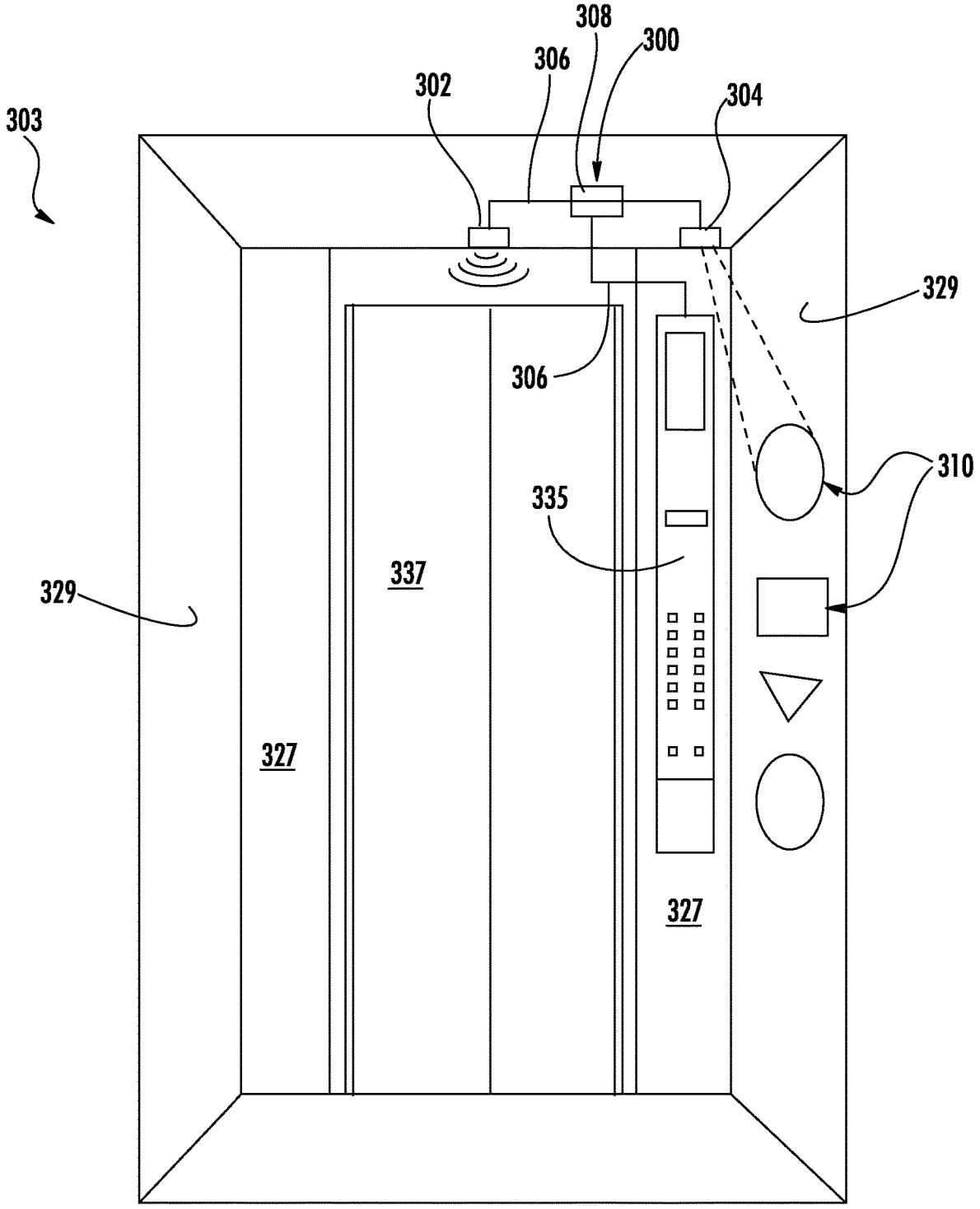
FIG. 3 is a perspective view of the inside of an elevator car equipped with a display device for a virtual image of a car operating panel in accordance with an embodiment of the present disclosure.

Turning now to FIG. 3, a schematic illustration of an elevator system in accordance with a non-limiting embodiment of the present disclosure is shown. In FIG. 3, an elevator car 303 includes a first elevator car panel 327 having a car operating panel 335 and configured about an elevator car door 337. The elevator car 303 also includes multiple second car panels 329.

As shown, the car operating panel 335 is located on the first elevator car panel 327 near the elevator doors 337. The car operating panel 335 is an electro-mechanical operating panel that includes buttons, touch-sensors, key pads, locks, displays, etc. as will be appreciated by those of skill in the art. Accordingly, the car operating panel 335 is fixed in place and physically located at a specific location within the elevator car 303. However, as noted above, the location of the car operating panel 335 may be difficult to reach for some passengers, particularly when the elevator car 303 is crowded.

In the embodiment of FIG. 3, the elevator car 303 is configured with a secondary car operating panel display system 300 in accordance with an embodiment of the present disclosure. The secondary car operating panel display system 300 is a detection and projection system that is configured to provide a virtual car operating panel in proximity to a passenger such that the passenger has easy access to a car operating panel and thus can conveniently control the elevator car 303 without the need to interfere with other passengers.

The secondary car operating panel display system 300 includes a detection and tracking device 302 and a display device 304. In some embodiments, such as shown in FIG. 3, the detection and tracking device 302 and the display device 304 can be physically separate and connected by a wired or wireless communication protocol 306. The secondary car operating panel display system 300 also includes a secondary car operating panel controller 308. The secondary car operating panel controller 308 can include memory, processor(s), and other electronic components that enable functionality as described herein and as will be appreciated by those of skill in the art. The secondary car operating panel controller 308 is configured to communicate with and control the detection and tracking device 302 and the display device 304. The communication protocol 306, as shown, can further connect the secondary car operating panel controller 308 with the car operating panel 335 (hereinafter referred to as a "primary car operating panel"). In some alternative configurations, two or more of the detection and tracking device 302, the display device 304, and the secondary car operating panel controller 308 can be a single unit (e.g., the controller and detection device can be housed in a single unit or all three components can form a single unit).

The detection and tracking device 302 is configured to detect the presence and location of passengers within the elevator car 303. That is, when a passenger enters the elevator car 303, the detection and tracking device 302 is configured to detect the new passenger and further track the location of the passenger as the passenger moves within the elevator car 303. The detection and tracking device 302, in some non-limiting embodiments, can include optical sensors, infrared sensors, cameras, proximity sensors, floor sensors, pressure sensors, acoustic sensors, motion sensors, etc. That is, the detection and tracking device 302, although shown installed in a ceiling of the elevator car 303, is not so limited. For example, in the case of pressure sensors, the detection and tracking device 302 can be installed in a floor of the elevator car 303. Further, for example, if proximity sensors are used, the detection and tracking device 302 can be installed in multiple locations in the ceiling of the elevator car 303 and/or located within one or more of the elevator car panels 327, 329. Further, in some embodiments, the detection and tracking device can be formed of multiple components with dedicated functionality. For example, in one non-limiting example, a primary detection device can be configured about the entry into the elevator car and can detect when a new passenger enters the elevator car through the elevator car doors. Such detection from the primary detection device can initiate tracking using one or more separate/independent tracking devices that will track the movement of the new passenger and determine the location of the new passenger.

The display device 304, similarly, can take various types of configurations. For example, as schematically shown, the display device 304 may include a projector to project a car operating panel image 310 on one of the elevator car panels 327, 329. That is, the car operating panel image 310 may form a secondary car operating panel that is a virtual car operating panel that is only displayed on an as-need basis. As shown, the car operating panel image 310 includes various geometric shapes that can indicate direction of movement of the elevator car 303 and/or can include floor numbers and/or destinations to be displayed for a passenger to view. The passenger can then touch the car operating panel image 310 at a desired location for a desired result. For example, the display device 304 can include an optical sensor to detect motion and/or placement of a passenger's hand or finger that is used to indicate a desired car operation (e.g., up, down, specific floor, etc.).

The car operating panel image 310 is displayed at a location proximate to a passenger's location as detected by the detection and tracking device 302. To enable this, the display device 304 is configured to provide a car operating panel image 310 on any wall or surface of the elevator car 303.

Although shown in FIG. 3 as a projector, those of skill in the art will appreciate that the display device 304 can take various forms. For example, in some embodiments, the display device 304 can include multiple projectors such that all desired locations for generating the car operating panel image 310 can be achieved. Further, in some embodiments, the display device 304 can be formed of one or more touch screens, wherein when the detection device detects the presence of a passenger, touch screen is activated and the car operating panel image 310 is displayed thereon. Further, in some embodiments, the car operating panel image 310 as generated by the display device 304 can be a hologram that can be displayed without the requirement of a surface (e.g., elevator car panel) to be displayed and recognized for passenger entry or selection.

Input from a passenger at the car operating panel image 310 by the display device 304 is processed by the secondary car operating panel controller 308. The secondary car operating panel controller 308 can then send a control signal to an elevator controller (e.g., elevator controller 115 shown in FIG. 1). In some embodiments, the secondary car operating panel controller 308 can send a signal to the primary car operating panel 335, which can then relay appropriate signals to control the elevator car 303 as desired. Further, in some embodiments, the primary car operating panel 335 is configured to interpret the input from the secondary car operating panel controller 308 as an input at the primary car operating panel 335 (e.g., an input from a physical or mechanical button) such that an appropriate floor button lights up as "selected" to indicate to other passengers that a particular floor has been selected and the elevator car will travel to and stop at the indicated floor.

Figure 4:
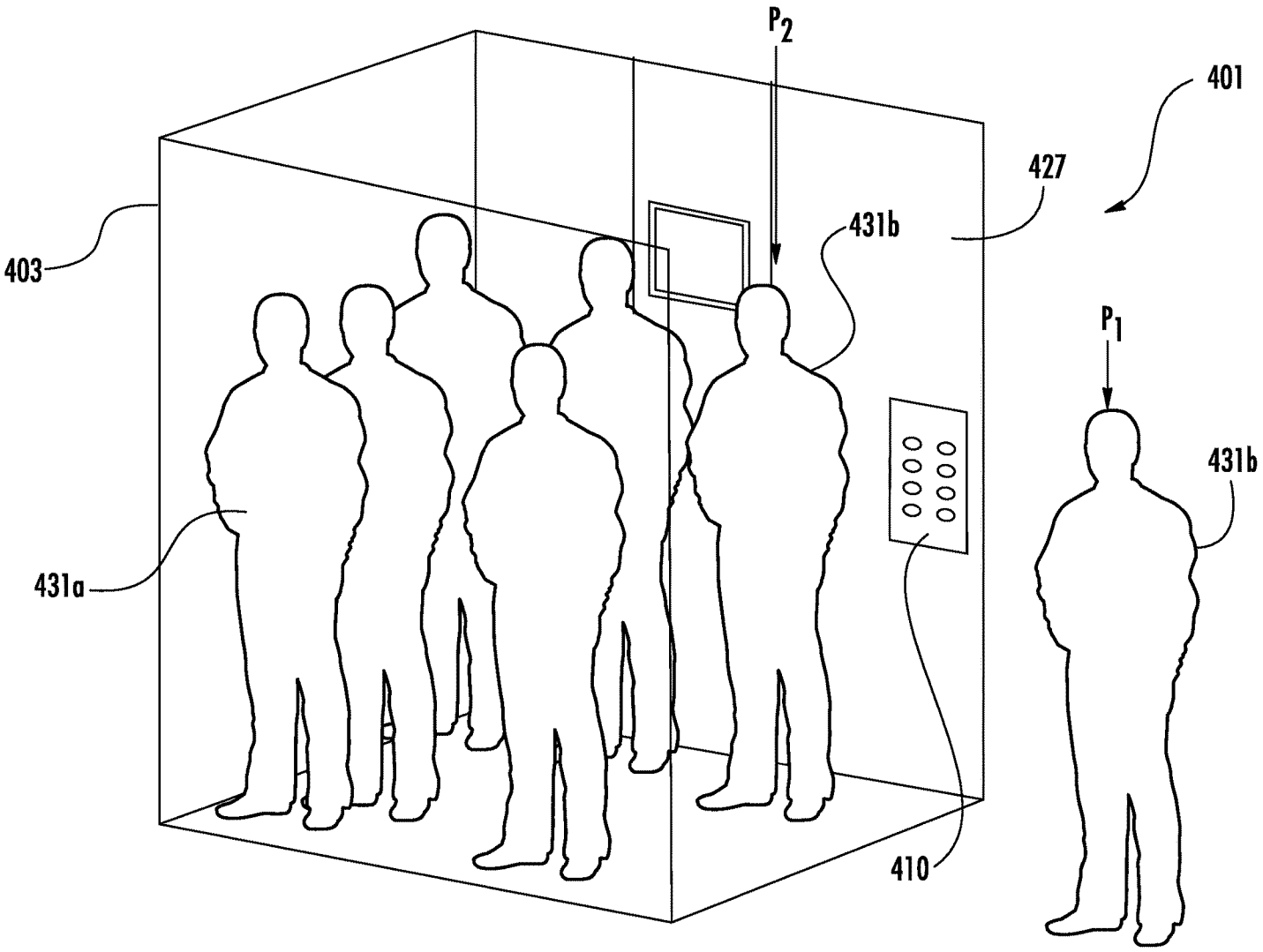
FIG. 4 is a schematic illustration of an elevator system that incorporates an embodiment of the present disclosure.
Figure 5:
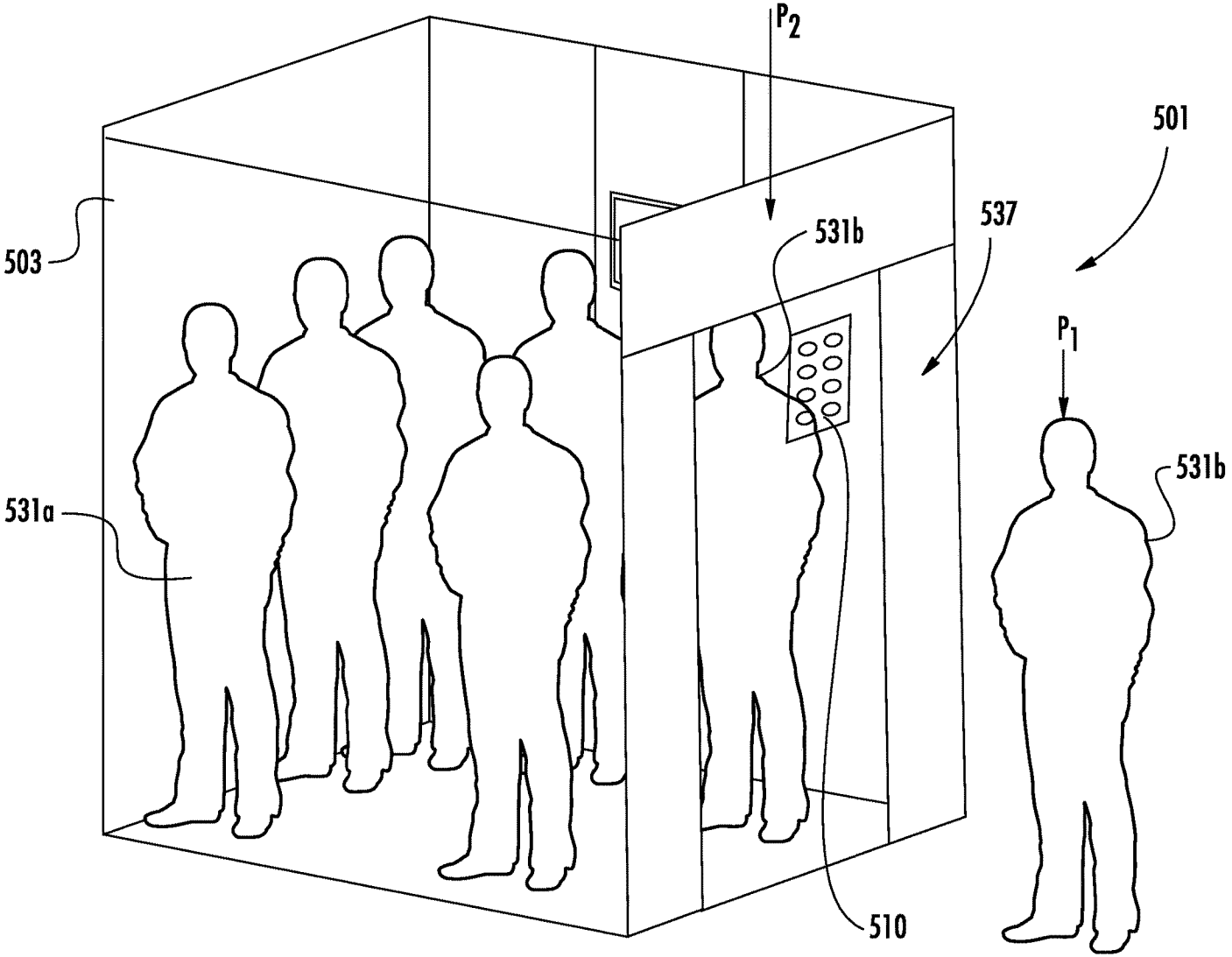
FIG. 5 is a schematic illustration of an elevator system that incorporates another embodiment of the present disclosure.

Turning now to FIGS. 4-5, schematic illustrations of elevator car systems 401, 501 incorporating embodiments of the present disclosure are shown. FIG. 4 illustrates a car operating panel image 410 as projected or displayed on an elevator car panel 427 of an elevator car 403. The elevator car 403 is relatively crowded as illustrated by the number of already present passengers 431*a*. In the illustration of FIG. 4, a new passenger 431*b* is shown outside the elevator car 403 (e.g., on a landing floor) at a first position $P_1$. When the new passenger 431*b* enters the elevator car 403, as indicated at a second position $P_2$, the new passenger 431*b* does not have easy access to a primary car operating panel of the elevator car 403. However, because the elevator car 403 is equipped with an embodiment of the present disclosure, a display device can project a car operating panel image 410 onto an elevator car panel 427 and thus provide a secondary car operating panel to the new passenger 431*b* at a convenient location.

FIG. 5 illustrates a car operating panel image 510 as a holographic display at an opening of an elevator door 537 of an elevator car 503. Similar to that shown in FIG. 4, the elevator car 503 is relatively crowded as illustrated by the number of already present passengers 531*a*. In the illustration of FIG. 5, a new passenger 531*b* is shown outside the elevator car 503 (e.g., on a landing floor) at a first position $P_1$. When the new passenger 531*b* enters the elevator car 503, as indicated at a second position $P_2$, the new passenger 531*b* does not have easy access to a primary car operating panel of the elevator car 503. However, because the elevator car 503 is equipped with an embodiment of the present disclosure, a display device can project a car operating panel image 510 (e.g., a hologram) into an opening of the elevator car doors 537 and thus provide a secondary car operating panel to the new passenger 531*b* at a convenient location.

Figure 6:
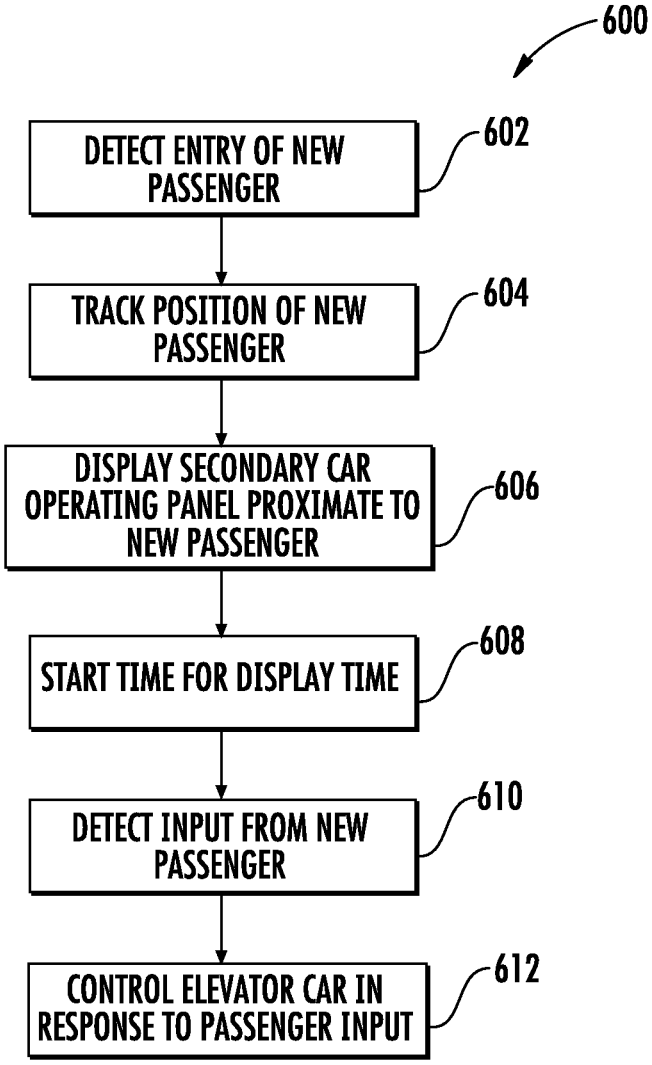
FIG. 6 is a flow process for controlling an elevator system in accordance with an embodiment of the present disclosure.

Turning now to FIG. 6, a non-limiting flow process for operating an elevator system in accordance with an embodiment of the present disclosure is shown. The flow process 600 can be a processing logic and control that is implemented in a controller (as described above) and can be used to display a secondary car operating panel to a passenger that may not have access to a primary car operating panel (e.g., if the elevator car is crowded).

At block 602, a detection and tracking device detects the entry of a new passenger into the elevator car. The detection can be initiated by a primary detection device that detects when a passenger enters the elevator car through an elevator car door. A secondary detection device or tracking device can be used to track the position of the new passenger within the elevator car, as shown at block 604. In some configurations, the initial detection and tracking can be performed by a single detection/tracking device, as described herein.

At block 606, a secondary car operating panel is displayed in proximity to the new passenger. The display may be of a car operating panel image that is projected on or display on an elevator car panel, as shown and described above, or may be a holographic image. The location of the display is based on the detection and tracking that is performed in blocks 602-604.

In some non-limiting embodiments, the controller and flow process may be modified to account for the location of a primary car operating panel in relation to the new passenger or based on other considerations. For example, in one non-limiting embodiment, if the position of the new passenger is detected within a predetermined distance from the primary car operating panel, the controller may not display a secondary car operating panel.

Alternatively, or in combination therewith, a controller may not display a secondary car operating panel if the primary car operating panel receives an input within a predetermined time of the new passenger entering the elevator car. For example, such logic may allow a new passenger to enter the elevator car, push a button on the primary car operating panel, and then move to a different location within the elevator car. As another example, the new passenger may speak with other already present passengers and such already present passengers may press a button on the primary car operating panel on behalf of the new passenger. Accordingly, in some embodiments, a wait period may exist between the operation of tracking a new passenger (blocks 602-604) and the operation of displaying a secondary car operating panel (block 606).

At the time the secondary car operating panel is displayed (block 606) the controller can start a clock or timer, at block 608, during which a display time will be performed. The display time may be a predetermined or preset amount of time that the secondary car operating panel will be displayed near the new passenger. At the end or expiration of the display time, if no input is received (block 610), the controller will cease displaying the secondary car operating panel. Such situation may arise when a new passenger enters an elevator car, notices that their desired destination floor is already selected, and thus will not need to enter or input a desired destination.

While the display time is running (block 608) a secondary car operating panel is displayed to a new passenger and, at block 610, the system is configured to detect an input by the passenger at the secondary car operating panel. Such detection may be made by known detection means, such as optical scanning and detection, as known in the art. In some embodiments, the input may be made on a screen or other displayed touch-based image. Various input mechanisms that can be employed in embodiments of the present disclosure can include, but are not limited to, cameras, analog optical detectors (e.g., able to read the activation position of the control elements by the passenger), infrared touch pads, resistive touch pads, acoustic surfaces or guided wave plates, capacitive plates which form a projection screen, etc.

Upon receiving input from the passenger, the system is configured to control the elevator car in response to the input, as shown at block 612. For example, if the new passenger selects a floor to travel to from the displayed secondary car operating panel, a controller will convey such information to an elevator controller and the elevator car will be able to travel to such desired floor. In some embodiments, the control can include indicating on the primary car operating panel that a particular floor has been selected.

Those of skill in the art will appreciate that various example embodiments are shown and described herein, each having certain features in the particular embodiments, but the present disclosure is not thus limited. That is, features of the various embodiments can be exchanged, altered, or otherwise combined in different combinations without departing from the scope of the present disclosure. Further, additional features and/or components can be incorporated into the easily accessible car operating panels (i.e., secondary car operating panels) described herein without departing from the scope of the present disclosure.

Advantageously, embodiments described herein provide easily accessible car operating panels such that passengers are not inconvenienced in crowded elevators.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator car comprising:

a primary car operating panel fixedly located on an elevator car panel; and a secondary car operating panel display system comprising:

a detection and tracking device configured to detect the entry and location of passengers within the elevator car;

a display device configured to display a secondary car operating panel at a location proximate to a detected and tracked passenger; and a secondary car operating panel controller operably connected to the detection and tracking device and the display device, wherein the secondary car operating panel controller is configured to receive input from the detection and tracking device, control the display device to display the secondary car operating panel at a specific location, and receive input from the display device in response to the display device detecting a passenger input.

2. The elevator car of claim 1, wherein the secondary car operating panel controller is configured to not display a secondary car operating panel if at least one of (i) the detected and tracked passenger is located within a predetermined distance from the primary car operating panel, (ii) an input is received at the primary car operating panel within a predetermined time from a time of detection of the passenger, or (iii) a display time expires without receiving an input at the secondary car operating panel.

3. The elevator car of claim 1, wherein the display device and the detection and tracking device are housed as a single unit.

4. The elevator car of claim 1, wherein the display device is at least one of an image projector, a touch screen, or a holographic projector.

5. The elevator car of claim 1, wherein the detection and tracking device includes at least one of an optical sensor, an infrared sensor, a camera, a proximity sensor, a floor sensor, a pressure sensor, an acoustic sensor, or a motion sensor.

6. A method for operating an elevator car having a primary car operating panel, the method comprising:

detecting entry of a passenger into the elevator car with a detection and tracking device;

tracking the position of the passenger within the elevator car with the detection and tracking device; and displaying a secondary car operating panel proximate to the detected and tracked passenger, wherein, prior to displaying the secondary car operating panel, at least one of (i) determining the position of the passenger relative to the primary car operating panel, (ii) determining a timing of an input at the primary car operating panel, or (iii) starting a display timer.

7. The method of claim 6, wherein at least one of (i) the secondary car operating panel is not displayed when the position of the passenger is within a predetermined distance from the primary car operating panel or (ii) the display of secondary car operating panel is stopped at the expiration of the display timer.

8. The method of claim 6, wherein when the input at the primary car operating panel occurs within a predetermined time of detecting entry of the passenger the secondary car operating panel is not displayed.

9. The method of claim 6, wherein the secondary car operating panel is displayed using at least one of an image projector, a touch screen, or a holographic projector.

10. The method of claim 6, wherein the detection and tracking includes use of at least one of an optical sensor, an infrared sensor, a camera, a proximity sensor, a floor sensor, a pressure sensor, an acoustic sensor, or a motion sensor.

11. The method of claim 6, further comprising detecting a passenger input at the secondary car operating panel.

12. The method of claim 11, further comprising controlling the elevator car in response to the passenger input.

13. The method of claim 11, further comprising indicating on the primary car operating panel information related to the passenger input.

* * * * *